United States Patent [19]

Maloney et al.

[11] Patent Number: 4,746,402

[45] Date of Patent: May 24, 1988

[54] GASKET FORMING PROCESS

[75] Inventors: Michael J. Maloney; Helmut F. Prahl, both of Madison, Wis.

[73] Assignee: Fel-Pro Incorporated, Skokie, Ill.

[21] Appl. No.: 853,984

[22] Filed: Apr. 21, 1986

[51] Int. Cl.[4] ..... D21J 3/00

[52] U.S. Cl. ..... 162/108; 162/157.1; 162/169; 162/223; 162/224; 162/228; 428/371; 428/377

[58] Field of Search ..... 162/390, 168.1, 145, 162/146, 169, 231, 218, 221, 222, 157.1, 223, 224, 227, 228, 108, 181.9; 428/371, 377; 277/DIG. 6, 230; 264/86, 87

[56] References Cited

U.S. PATENT DOCUMENTS

| | | | |
|---|---|---|---|
| 906,044 | 12/1908 | Malcolm . | |
| 2,995,187 | 8/1961 | Wells | 162/390 |
| 3,064,727 | 11/1962 | Hartmann et al. . | |
| 3,151,021 | 9/1964 | Balch | 162/108 X |
| 3,654,076 | 4/1972 | Hatch . | |
| 3,661,707 | 5/1972 | Emery et al. . | |
| 3,816,049 | 6/1974 | Peppler . | |
| 4,213,620 | 7/1980 | Kennedy et al. . | |
| 4,337,116 | 6/1982 | Foster et al. . | |
| 4,435,235 | 3/1984 | Atkinson et al. . | |
| 4,443,517 | 4/1984 | Shah | 162/181.9 |
| 4,448,640 | 5/1984 | Brault et al. . | |

OTHER PUBLICATIONS

Kevlar, A Reinforcing Fiber Substitute for Asbestos by Du Pont.

*Primary Examiner*—Peter Chin
*Assistant Examiner*—Thi Dang
*Attorney, Agent, or Firm*—Dressler, Goldsmith, Shore, Sutker & Milnamow, Ltd.

[57] ABSTRACT

A process of forming a gasket with a minimal production of waste material is disclosed. A suitable fiber is mixed with a binder in water to form a fiber-binder aqueous mixture. The mixture is then deposited on a screen in a predetermined pattern to form a gasket preform with apertures in predetermined locations therein. The gasket preform is subsequently dewatered and cured. The gasket preform can be provided with differential thicknesses and preformed inserts to impart, respectively, selective control of the sealing capability of and reinforcement to the resulting gasket.

12 Claims, 2 Drawing Sheets

FIG. 2
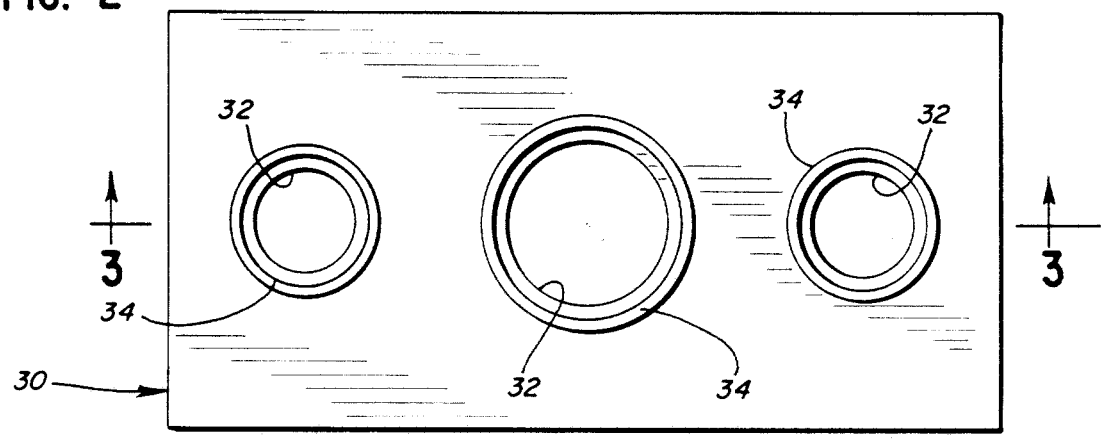
FIG. 3
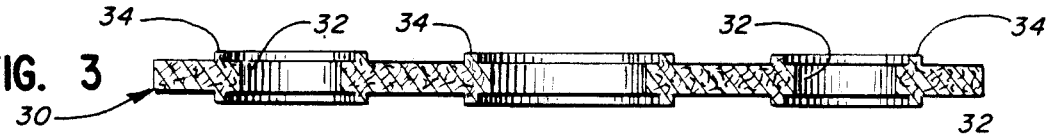
FIG. 4
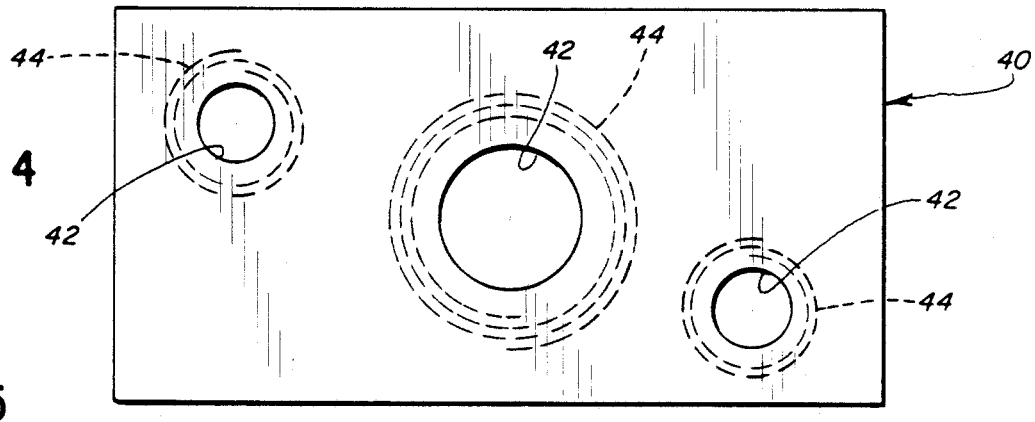
FIG. 5
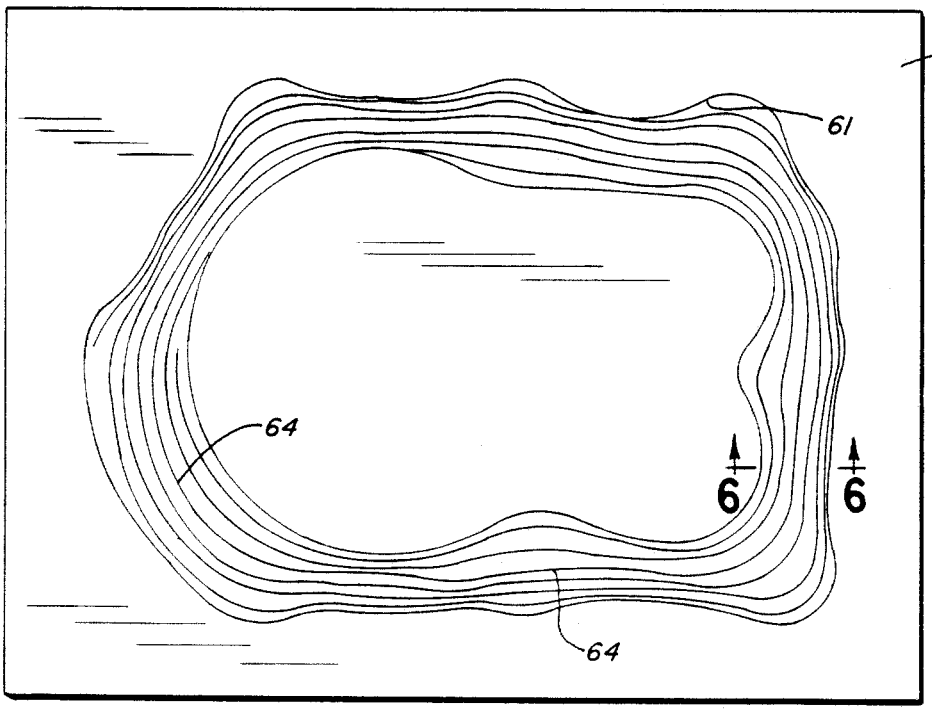
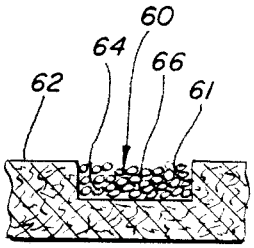
FIG. 6

GASKET FORMING PROCESS

BACKGROUND OF THE INVENTION

This invention relates to a process of forming a gasket. More particularly, the invention relates to a process of forming a gasket with a minimal production of waste material.

Gaskets are widely used for providing seals between pairs of confronting surfaces, such as between engine blocks and heads in internal combustion engines, and the like. Gaskets used in such applications must provide an effective seal between the relatively large number of interconnecting cavities carrying fluids of different types and under different pressures so that the fluids do not intermingle or leak externally.

Currently, gaskets are prepared from sheets which are typically made by the Fourdrinier paper process. In that process, sheets are made by continuously depositing latex treated fibers (stock) from a very low consistency aqueous suspension onto one end of a Fourdrinier wire. A Fourdrinier wire is a relatively finely woven endless screen belt that travels around and between two large rolls, a solid breast roll at a headbox from which the stock is discharged onto the belt, and perforated couch rolls having vacuum chambers inside. The partially dewatered stock then passes over suction boxes that drain away at least 95 percent of the water, leaving a wet paper web on the upper surface of the belt. The web is removed continuously from the wire at, or closely following, the end of the suction zone in the couch roll. The wet paper web is subsequently pressed to remove any remaining excess water and is then dried prior to being transferred to a reel.

U.S. Pat. Nos. 4,448,640, 3,654,076 and 3,064,727 disclose rotary pulp-molding machines in which pulp is picked up from a slurry in molding dies, and is then transferred, frequently by an intermediate device, to a conveyor belt. The intermediate device may remove some of the water. The resulting object shaped by the molding dies, such as a pulp tray or the like, is then carried by the conveyor belt through a dryer to remove excess water.

Problems have been encountered in current processes for forming gaskets, as by using Fourdriner wire and/or pulp molding machines both of which are used to produce solid sheets which require subsequent die cutting, in that a significant amount of waste material is produced. Further, separate and additional treatment of the gaskets formed thereby is required to add thickness and strength to desired areas of the gaskets. Thus, a gasket-forming process that produces a minimal amount of waste material, as contrasted to conventional gasket forming processes in which up to 60% of the sheet is cut away and wasted, and one which produces gaskets exhibiting differential thicknesses and increased strength in specified areas is to be desired.

SUMMARY OF THE INVENTION

In accordance with the present invention, a process for forming a gasket with a minimal production of waste material is provided. This is especially important where expensive fibers are used to replace low-cost fibers, such as those of asbestos. The process comprises providing and preparing suitable fibers to be formed into a gasket preform. The fibers are then mixed in water with a binder to form a fiber-binder aqueous mixture that is deposited on a screen in a predetermined pattern thereby forming a gasket preform with apertures in predetermined locations therein. Subsequently, the gasket preform is dewatered to remove excess liquid therefrom and is heated in a curing chamber to form a gasket. The gasket preform may be trimmed either before or after curing.

In another aspect of the present invention, the process of forming a gasket further comprises the additional step, prior to heating, of pressing the gasket preform in a suitable die to provide differential thickness in the gasket preform. In this manner, the sealing capability of the resulting gasket is selectively controlled in different zones thereof.

In yet another aspect of the present invention, the process of forming a gasket includes the additional step, that can be implemented at various stages of the process, of depositing a preformed insert, such as a preformed fiber insert, in a localized area, as around an aperture, of the gasket preform. In this manner, additional reinforcement and strength is imparted to the resulting gasket at desired localized areas.

Further objects, features, and advantages of the present invention will become apparent from the following description and drawings.

BRIEF DESCRIPTION OF THE DRAWINGS

FIG. 2 is a view illustrating an exemplary gasket formed by the process of the present invention;

FIG. 3 is a cross-sectional view taken along line 3—3 of FIG. 2;

FIG. 4 is a view illustrating another exemplary gasket formed by the process of the present invention;

FIG. 5 is a view illustrating the deposition of continuous fibers in a gasket preform of the present invention; and FIG. 6 is a cross-sectional view taken along line 6—6 of FIG. 5.

DESCRIPTION OF THE PREFERRED EMBODIMENT

Figure 1:
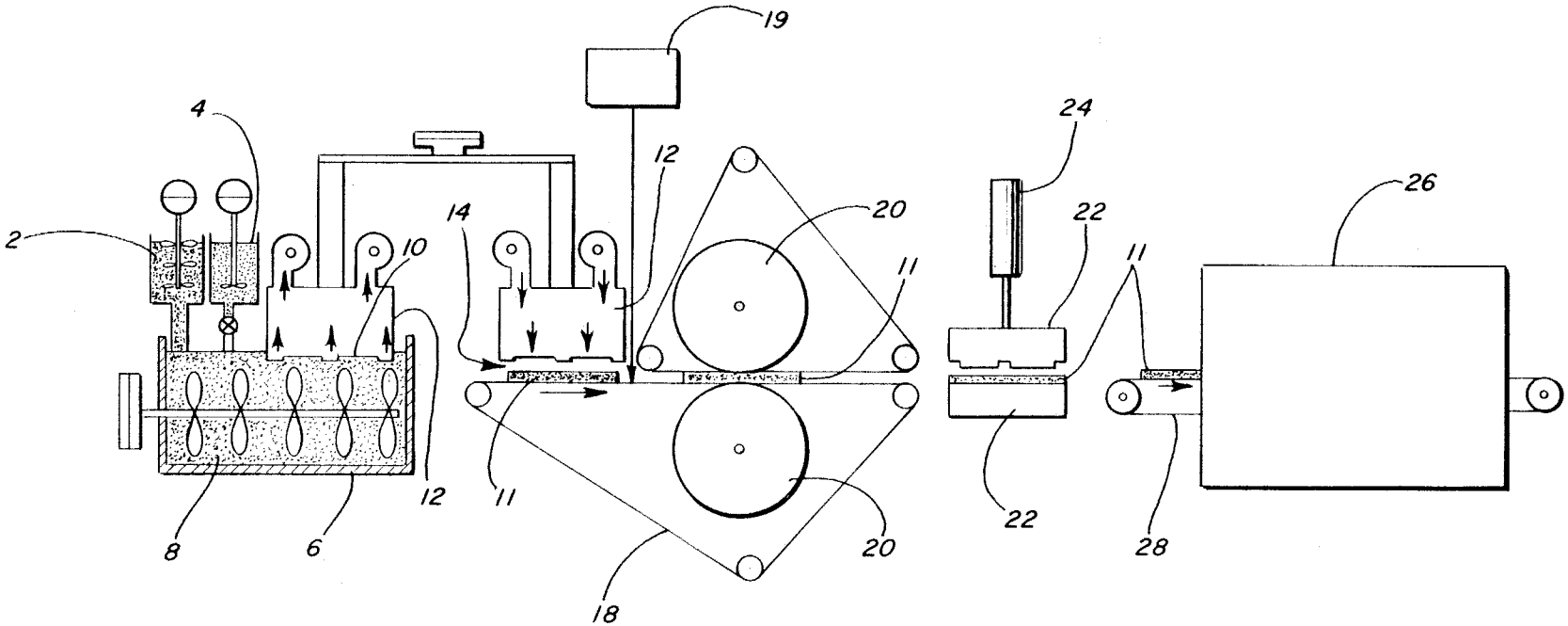
FIG. 1 is a flow diagram illustrating a process of forming a gasket of the present invention.

The present invention is directed to a process of forming a gasket, such as a gasket for use in an internal combustion engine or the like, with a minimal production of waste material to be discarded after the gasket is formed.

In a preferred embodiment of the process of the present invention, suitable fibers to be preformed into a gasket are provided and suitably prepared. Exemplary materials from which fibers suitable for use in the process of the invention may be prepared are aromatic polyamides, rayon, glass, cellulose, asbestos, and mixtures of aromatic polyamides and rayon, aromatic polyamides and glass, aromatic polyamides and cellulose, cellulose and rayon, cellulose and glass, and alumina fibers and carbon fibers. Other fibers may be usable as well. The preferred fibers are made of aromatic polyamides. Particularly preferred fibers are of Kevlar, that is a trademark of E. I. DuPont de Nemours & Co. for an aromatic polyamide fiber of extremely high tensile strength and having a greater resistance to elongation than steel. Kevlar fibers have previously been proposed for use in automotive gaskets.

The fibers are then mixed, as in water, with a binder to form an aqueous fiber-binder mixture. Exemplary materials from which binders suitable for use in the process of the invention may be prepared are nitrile rubber, polyacrylates, styrene-butadiene rubber, chlorinated styrene-butadiene rubber, carboxylated nitrile rubber, carboxylated styrene-butadiene rubber, polyvinyl chloride, ethylene-propylene diene monomer, acrylonitrile-butadiene-styrene copolymer, neoprene and fluoroelastomers. The preferred binder is nitrile rubber binder. Nitrile rubber is a synthetic rubber made by random polymerization of acrylonitrile with butadiene by free radical catalysis.

The resulting fiber-binder aqueous mixture is then deposited on a screen in a predetermined pattern to form a gasket preform with preformed apertures in predetermined locations. The deposition can be accomplished by picking up the fiber-binder aqueous mixture by suction means by which the mixture is partially dewatered to form a gasket preform. The gasket preform is then transferred to the screen by pressure means and is subsequently dewatered, as by suction means, such as a suction box, and/or by pressure means, such as pressure rollers, to remove excess liquid from the gasket preform. The dewatered gasket preform is then heated in a curing chamber to cure the binder therein, thereby to provide a finished or gasket.

The resulting gasket preformed by the process of the present invention may be trimmed, if necessary, to remove any small amount of excess flash or waste material formed either prior to or after curing.

In another embodiment of the present invention, prior to curing, the gasket preform may be pressed in a suitable die or dies to shape the gasket further and to impart desired areas of differential thicknesses in the gasket. By imparting areas of differential thicknesses to the gasket, different surface characteristics desirable for different sealing needs are exhibited in the same gasket for the surfaces which the gasket ultimately confronts in its final use. An exemplary method of imparting areas of differential thicknesses to a gasket is described in U.S. Pat. No. 4,213,620, the disclosure of which is incorporated herein by reference.

In yet another embodiment of the present invention, at various stages of the process of the invention, such as prior to dewatering, preformed inserts can be interposed in predetermined, localized areas of the deposited fiber-binder aqueous mixture to provide additional reinforcement and strength to the gasket or different sealing characteristics thereto, such as around apertures or openings therein. Suitable preformed inserts that can be interposed or deposited in predetermined locations of the gasket may be comprised of continuous fibers such as spiral wound yarn or thread.

The process of the present invention is further illustrated with reference to FIG. 1. Suitable fibers 2 are provided and prepared to be preformed into a gasket. The fibers 2 are mixed in a carrier, such as water, with binder 4 in a mixer 6 to form an aqueous fiber-binder mixture 8, as of the ingredients identified in the Example, infra. The resulting aqueous mixture 8 is drawn against a screen 10 by a suction means, that can be a suction box 12. The preform forming surface of the suction box is the screen 10 with solid zones therein to define the desired gasket preform 11. The gasket preform 11 is then carrie, as by rotating the suction box 12, to a discharge zone 14 at which suction is discontinued and pressure is applied to force the preform 11 from the screen 10 downwardly against and onto a screen conveyor 18. The suction means 12 removes a portion of the water in the fiber-binder mixture. Water will continue to drain through the screen conveyor 18 as the preform is transported toward pressure rollers 20.

Prior to movement to the pressure rollers, inserts, such as spiral wound fiber inserts, may be deposited on or in the gasket preform 11, as from a supply 19 of preformed inserts.

As described above, screen conveyor 18 carries the gasket preform 11 through dewatering means, such as pressure rollers 20, to remove the great majority of the remaining water from preform 11. If desired, suction boxes may also be placed below screen conveyor 18 either upstream or downstream of the pressure rollers 20 to act as further dewatering means.

Optionally, the gasket preform 11 may then be transported between a matched pair of metal die molds 22, driven by a cylinder 24, to thereby further shape the gasket preform in a vertical plane, for example to provide areas of differential thicknesses on the gasket preform surface. Alternatively, embossing rollers or the like can be utilized for the further shaping of the gasket preform 11.

The gasket preform 11 then is carried through a curing oven or chamber 26, as on a conveyor 28, in which the binder in the gasket is cured and any remaining excess water is removed, thereby to provide a finished gasket. Trimming of flash or other post-formation treatments to complete the gasket may be employed thereafter.

Fibrous batts and gaskets in accordance with the foregoing have been prepared of other fibers than the Kevlar fibers referred to in the Example, infra. Other such fibers are: ¼" rayon fiber, ⅛" glass fiber, cellulose pulp, chrysolite (asbestos) fiber, ¼" nylon fiber, ⅛" polyester fiber, and alumina fiber. Additionally, mixtures of fibers of the following have been used in the weight ratios indicated:

rayon:Kevlar (25:75, 50:50 and 75:25);
cellulose:Kevlar (25:75, 50:50 and 75:25); and
nylon:Kevlar (50:50).

Exemplary gaskets as produced according to the process of the present invention are shown in FIGS. 2 and 4. FIG. 2 illustrates a gasket 30 having a plurality of apertures 32 therein. The gasket 30 has been provided with raised areas 34 of differential thickness to provide the gasket with increased sealing capability by precompressing the preform, as in die molds 22, in all areas except in the areas 34. FIG. 4 illustrates a gasket 40 having a plurality of apertures 42, around each of which a preformed spiral wound yarn insert 44 has been interposed as described hereinafter to provide additional reinforcement and strength around apertures 42.

EXAMPLE

With reference to FIGS. 5 and 6, in order to demonstrate that a preformed insert, such as a continuous wound fiber loop, can be interposed in predetermined locations of a gasket preform in the process of the present invention, a fiber-binder batt was prepared from the following: 12.7 grams of 4 millimeter Kevlar pulp, 12.0 grams of Huber clay, 2.0 grams of carbon dispersion, 19.8 grams of 1571 Hycar resin (nitrile rubber binder), 1.2 grams of butyl zimate dispersion, 0.8 grams of zinc oxide dispersion, 0.6 grams of sulfur dispersion, 600 milliliters of water, and 200 milliliters of 2 percent alum solution.

The fiber-binder batt, namely a partially dewatered gasket preform 60, was deposited in a cavity 61 in a head gasket mold 62. An insert comprising a multi-turn loop 64 of 200 denier Kevlar 29 continuous fiber was then placed in the mold cavity 61. A second preformed loop 66 was placed over the loop 64 and then the resulting assembly was pressed by a matched metal die to integrate the assembly. The assembly was then further dewatered and cured.

The process of layering preforms and loops can be repeated as often as desired in a single gasket preform assembly and, in the above example, gasket preform assemblies having as many as 6, 12 and 18 layers of Kevlar continuous fiber loops were prepared in accordance with the present invention.

The foregoing is intended as illustrative of the present invention but not limiting. Numerous variations and modifications may be effected without departing from the true spirit and scope of the invention.

What is claimed is:

1. A process of forming an individual gasket with a minimal production of waste material which comprises:

(a) providing suitable fibers to be formed into a gasket preform;

(b) mixing said fibers with a binder in water to form a fiber-binder aqeuous mixture;

(c) depositing and partially dewatering said fiber-binder aqueous mixture on a preform forming screen in a predetermined pattern thereby forming, from the deposited mixutre and prior to any trimming, a gasket preform with apertures in predetermined locations in the gasket preform to obtain a partially dewatered gasket preform;

(d) pressing said partially dewatered gasket preform thereby to remove excess water therefrom; and (e) heating said pressed gasket preform in a curing chamber to cure said binder therein, thereby to form, from the heated preform, a gasket.

2. The process of claim 1 further comprising the additional step prior to step (e) of pressing said gasket preform in a suitable die to provide differential thicknesses in said gasket preform thereby to selectively control the sealing capability of the gasket in different zones thereof.

3. The process of claim 1 further comprising the additional step prior to step (e) of interposing a preformed insert in predetermined areas of said gasket preform, thereby to provide additional reinforcement thereat.

4. The process of claim 3 wherein said insert comprises at least one multi-turn loop of continuous fiber.

5. The process of claim 4 wherein such an insert is interposed so as to reinforce each aperture in the gasket preform.

6. The process of claim 1 further comprising the additional step prior to step (e) of trimming said gasket preform to remove waste material.

7. The process of claim 1 further comprising the additional step of trimming the gasket obtained after step (e) to remove waste material.

8. The process of claim 1 wherein said fibers are comprised of a material selected from the group consisting of aromatic polyamides, rayon, glass, cellulose, asbestos, and mixtures of aromatic polyamides and rayon, aromatic polyamides and glass, aromatic polyamides and cellulose, cellulose and rayon, cellulose and glass, alumina, and graphite.

9. The process of claim 1 wherein said binder is comprised of a material selected from the group consisting of nitrile rubber, polyacrylate, styrene-butadiene rubber, chlorinated styrene, butadiene rubber, carboxylated nitrile rubber, carboxylated styrene-butadiene rubber, polyvinyl chloride, ethylene-propylene diene monomer, acrylonitrile-butadiene-styrene copolymer, neoprene and fluoroelastomers.

10. The process of claim 1 wherein step (c) is performed by applying suction to form and partially dewater said fiber binder aqueous mixture on said preform forming screen, transferring said partially dewatered preform from said preform forming screen onto a screen conveyor by applying air pressure through said preform forming screen to deposit and transfer said partially dewatered preform onto a screen conveyor, said screen conveyor passing said partially dewatered preform to step (d).

11. The process of claim 1 wherein the partial dewatering of step (c) comprises dewatering by suction through said preform forming screen.

12. A process of forming an individual gasket with a minimal production of waste material which comprises:

(a) providing suitable fibers to be formed into a gasket preform;

(b) mixing said fibers with a binder in water to form a fiber-binder aqueous mixture;

(c) depositing and partially dewatering said fiber-binder aqueous mixture on a preform forming screen in a predetermined pattern thereby forming, from the deposited mixture and prior to any trimming, a gasket preform with apertures in predetermined locations in the gasket preform to obtain a partially dewatered gasket preform;

(d) depositing a preformed insert in predetermined areas of said gasket preform thereby to provide additional reinforcement thereat;

(e) further dewatering said partially dewatered gasket preform thereby to remove excess liquid therefrom;

(f) pressing said gasket preform in a suitable die to provide differential thicknesses in said gasket preform thereby to selectively control the sealing capability of said gasket in different zones thereof; and (g) heating said pressed gasket preform in a curing chamber to cure said binder therein, thereby to form, from the heated preform, a gasket.

* * * * *